United States Patent [19]

Jinnings et al.

[11] Patent Number: 4,634,311

[45] Date of Patent: Jan. 6, 1987

[54] PAVEMENT BREAKING APPARATUS

[75] Inventors: John W. Jinnings; Orrin H. Jinnings, both of Columbia City, Ind.

[73] Assignee: Hercules Machinery Corporation, Fort Wayne, Ind.

[21] Appl. No.: 703,303

[22] Filed: Feb. 20, 1985

[51] Int. Cl.[4] ..... E01C 23/12

[52] U.S. Cl. ..... 404/90; 404/133; 299/69; 241/101.7; 173/43; 173/89; 173/128

[58] Field of Search ..... 404/90, 113, 133; 241/101.7; 173/43, 89, 128, 133; 299/37, 69

[56] References Cited

U.S. PATENT DOCUMENTS

| | | | |
|---|---|---|---|
| Re. 25,401 | 6/1983 | Clynch | 181/0.5 |
| 894,269 | 7/1908 | Hendron | 299/37 |
| 1,654,014 | 12/1927 | Proctor et al. | 404/133 |
| 2,335,172 | 11/1943 | Cornett | 173/28 |
| 2,659,583 | 11/1953 | Dorkins | 173/28 |
| 2,659,584 | 11/1953 | Dorkins | 173/28 |
| 2,893,299 | 7/1959 | Moir | 404/113 |
| 3,172,483 | 3/1965 | Spitzer | 173/43 |
| 3,253,522 | 5/1966 | Piper | 404/113 |
| 4,439,056 | 3/1984 | Reilly et al. | 404/90 |

FOREIGN PATENT DOCUMENTS

| | | | |
|---|---|---|---|
| 482305 | 3/1938 | United Kingdom | 404/133 |

*Primary Examiner*—Stephen J. Novosad
*Assistant Examiner*—John F. Letchford
*Attorney, Agent, or Firm*—Jeffers, Irish & Hoffman

[57] ABSTRACT

An apparatus for impacting on a hard surface such as concrete so as to break up the hard surface. This apparatus comprises a frame having a bed and an upstanding rail assembly projecting from the bed, a drive shoe, a hammer means attached to the rail assembly so as to be movable in only one direction and operatively connected to the drive shoe for impacting upon the drive shoe. The drive shoe lies adjacent the surface so that upon impact from the hammer means, the shoe forcefully impacts the surface so as to break up the surface. An adjustment means is used to selectively position the drive shoe relative to the hammer means.

12 Claims, 12 Drawing Figures

PAVEMENT BREAKING APPARATUS

BACKGROUND OF THE INVENTION

The invention relates to an apparatus for breaking concrete pavements, and more particularly, to a pavement breaking apparatus which does not operate with a pendulum-like swinging or rocking during pavement breaking.

Pavement breaking machines use a power driver, better known as a pile-driver, mounted on a movable chassis and towed along the concrete pavement. As the machine is towed along the pavement, heavy blows of the pile-driver cause the drive shoe to impact the pavement and break off successive chunks of concrete. The broken concrete is then available to be gathered up and crushed in a portable crushing plant for recycling.

Some of the earlier pavement breaking machines have hammers which either rock or swing in a pendulum-like manner as the machine is towed forward during the breaking operation. Such swinging or rocking can cause excessive wear of a layer of cushion material located above the neck of the drive shoe received within the adapter opening. As the hammer rocks or swings, the neck portion of the drive shoe jams against the walls of the adapter opening containing the cushion material. This jams the drive shoe neck against the adapter so as to drive the cushion material out of the adapter opening. This is, of course, an undesirable result. It would thus be desirable to provide a pavement breaking apparatus that operates without pendulum-like swinging or rocking so as to reduce or eliminate deformation of the cushion material.

This pendulum-like swinging or rocking can also result in increased stress on the upper frame structure through torsional loading. This stress may result in the premature failure of the mast and hammer. Torsional loading may also cause the hydraulic or electric lines associated with the pavement breaking apparatus to whip back and forth. It would thus be desirable to provide a pavement breaking apparatus that operates without a pendulum-like swinging or rocking so as to eliminate torsional loading on the upper frame.

Pendulum-type drivers exert an angular-type of strike against the pavement. In other words, the strike of a pendulum-type driver is divided into a vertical force component and a horizontal force component. The presence of a horizontal force component is undesirable since it reduces the vertical force exerted on the pavement to break it. It would thus be desirable to provide a pavement breaking apparatus that operates without a pendulum-like swinging or rocking so as to transmit a substantially vertical blow to the pavement.

SUMMARY OF THE INVENTION

It is thus an object of the invention in one form thereof to provide an improved pavement breaking apparatus which does not operate with a pendulum-like swinging or rocking during the pavement breaking operation.

It is another object of the invention in one form thereof to provide a pavement breaking apparatus that operates without pendulum-like swinging or rocking so as to reduce or eliminate deformation of the cushion material located above the neck of the drive shoe received within the adapter opening.

It is another object to the invention in one form thereof to provide a pavement breaking apparatus that operates without pendulum-like swinging or rocking so as to eliminate torsional loading on the upper frame structure.

Finally, it is an object of the invention in one form thereof to provide a pavement breaking apparatus that transmits substantially vertical blows to the pavement.

In one form thereof, the invention is an apparatus for breaking up a hard surface such as concrete. The apparatus comprises a frame having an elongate bed with opposite front and rear ends. The bed is disposed so as to be generally parallel with the surface. The frame further includes a rail assembly mounted to the bed and being disposed generally normally to the surface.

A set of wheels is mounted to the bed adjacent the rear end thereof. The front end of the bed are connected to a support so that the bed is spaced above the surface. A drive shoe is positioned adjacent the surface.

The apparatus further includes a hammer means for repetitively impacting against the drive shoe so as to break up the surface. The hammer means is mounted to the rail assembly and is operatively connected to the drive shoe. The apparatus further includes an adjustment means for selectively positioning the drive shoe relative to the hammer means.

In another form thereof, the invention is an apparatus for impacting on a hard surface such as concrete so as to break up the hard surface comprising a frame having a bed and an upstanding rail assembly projecting from the bed. The apparatus further includes a drive shoe and hammer means, which is attached to the rail assembly so as to be movable in only one direction and operably connected to the drive shoe, for impacting upon the drive shoe. The drive shoe is positioned adjacent the surface so that upon being impacted by said hammer means, the shoe forcefully impacts the surface so as to break up the surface. The apparatus further includes an adjustment means for selectively positioning the drive shoe relative to the hammer means.

In one form thereof, the invention is an apparatus for impacting upon a surface comprising a frame having a bed and an upstanding rail assembly mounted to the bed. A hammer assembly is mounted to the rail assembly. A selected one of a pair of shoes is operatively connected to the hammer assembly. Each of the shoes includes a bottom face facing the surface. One of the shoes has a generally flat bottom face so as to tamp the surface upon impacting.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings.

DETAILED DESCRIPTION OF A SPECIFIC EMBODIMENT

Figure 1:
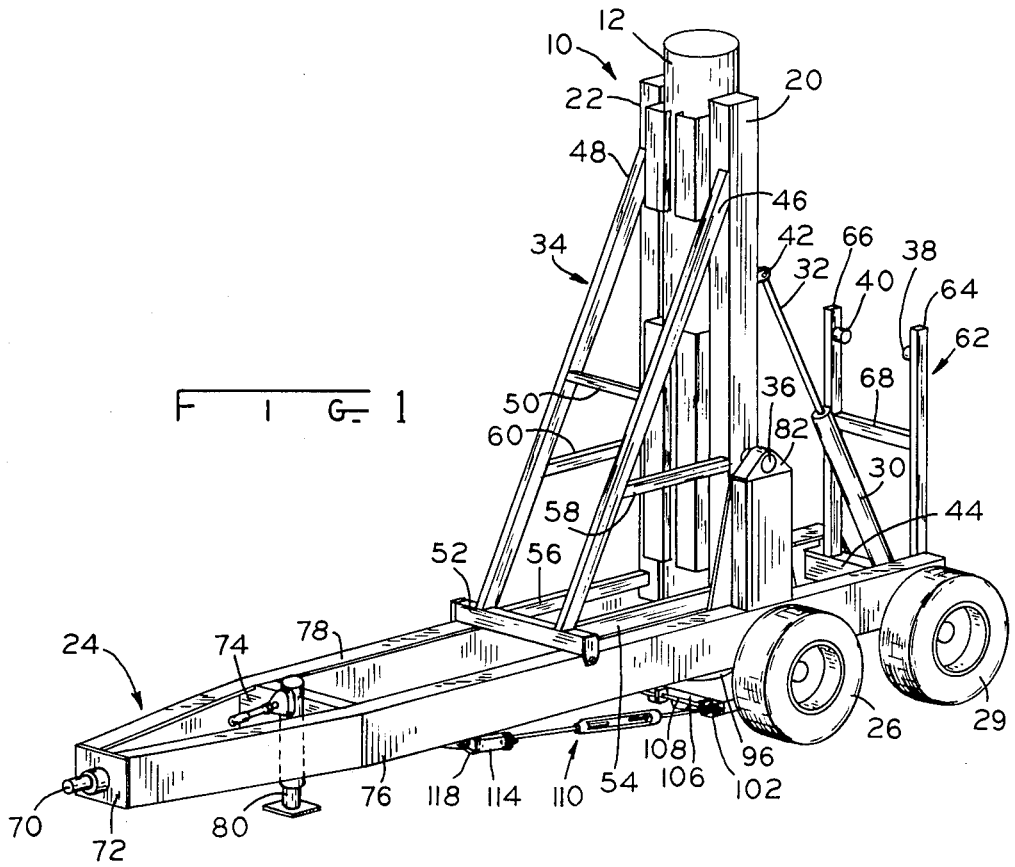
FIG. 1 is a perspective view of a specific embodiment of the apparatus of the invention.
Figure 2:
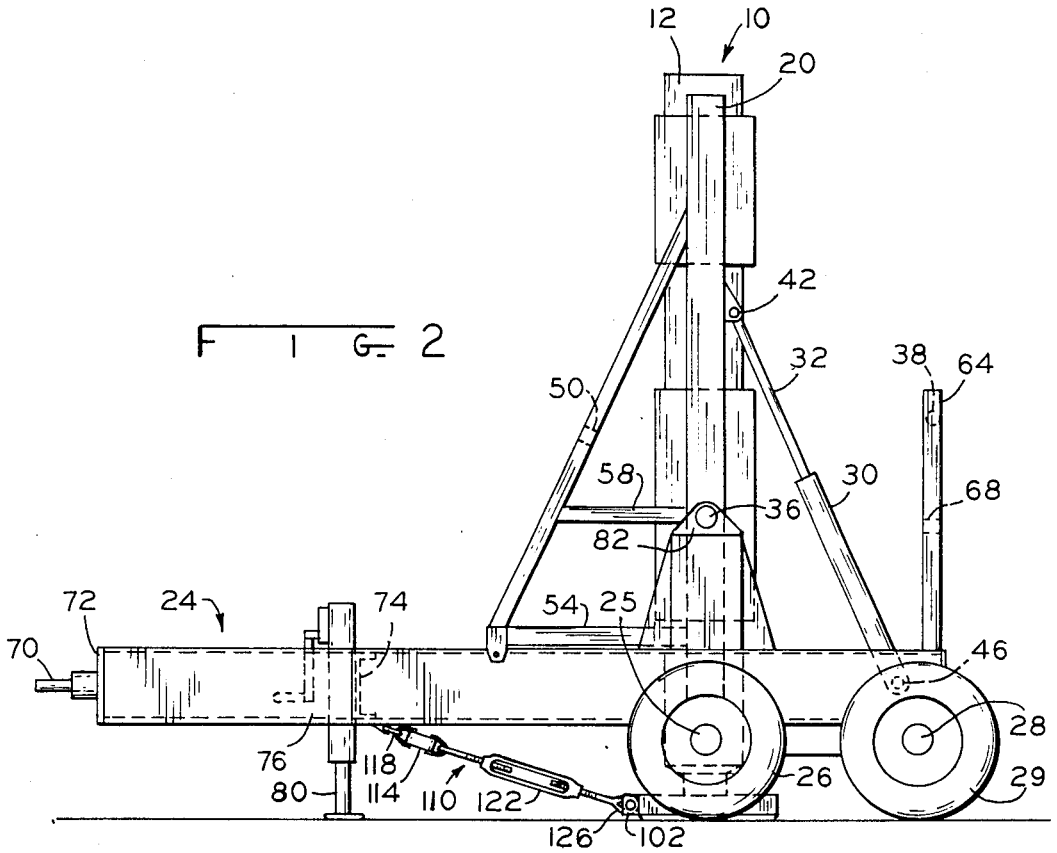
FIG. 2 is a side plan view of the specific embodiment illustrated in FIG. 1.
Figure 3:
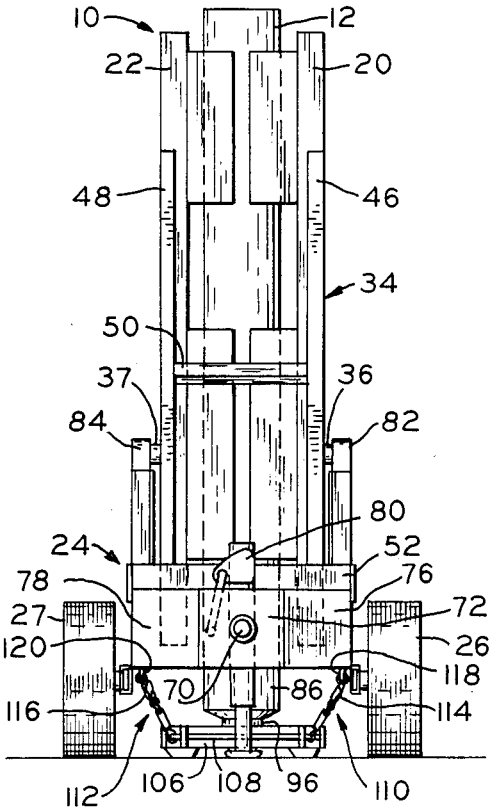
FIG. 3 is a front plan view of the specific embodiment illustrated in FIG. 1.

Referring now to FIGS. 1–3, there is shown an apparatus for crushing pavement generally indicated as 10. The crushing blows to the pavement are delivered by a power hammer 12 of a type more commonly known as a pile driver. The power hammer 12 used in this embodiment is International Construction Equipment, Inc.'s Model 520 Diesel Pile Hammer. The details of this Model 520 Diesel Pile Hammer are not shown or described since they are not changed by the present invention. The operation of the power hammer 12 will be generally described hereinafter with specific reference to FIGS. 6A, 6B and 6C.

The pavement crushing apparatus 10 further includes an elongate mobile chassis generally designated as 24. Chassis 24 includes one axle 25 connecting one pair of wheels 26, 27, and another axle 28 connecting to another pair of wheels of which only wheel 29 is shown. During operation, chassis 24 is towed in a conventional fashion by a tractor so that it is not necessary to describe in detail the manner of towing the chassis 24. The tractor used to tow the chassis 24 also provides power for the apparatus 10.

Chassis 24 further includes a rearward cross bar 44. A pivot rest frame 62 is attached to rearward cross bar 44. Pivot rest frame 62 includes a pair of vertical members 64 and 66 connected together by a cross bar 68. Cross bar 68 is positioned intermediate the top and bottom ends of the vertical members. A pair of pivot rests 38 and 40 extend inwardly from the upper portions of vertical members 64 and 66, respectively.

A forward narrow cross member 72 is located at the forward end of the chassis 24 and extends between longitudinal members 76 and 78. A wider cross bar 74 is positioned rearwardly of cross member 72 and also extends between longitudinal members 76 and 78. Chassis 24 further includes a vertically adjustable stationary support such as a jack 80. Jack 80 includes a handle 81 positioned intermediate opposite ends of cross bar 74. Handle 81 vertically adjusts support 80 to maintain chassis 24 in a substantially level position above the surface of the ground when chassis 24 stands free of any towing vehicle.

Chassis 24 further includes a pair of vertically disposed lateral brace members 82 and 84 each having a transverse opening through its upper end section. Each lateral brace member is wider at its lower end portion or base and narrows as it extends upwardly from lateral members 76 and 78. Lateral brace members 82 and 84 are positioned so as to be substantially over the opposite ends of axle 25. Pivot pins 36 and 37 connect upright guide rails 20 and 22 to chassis 24 by extending through the transverse openings in upper sections of lateral brace members 82 and 84, respectively. The wider base of the lateral brace members provides greater stability to withstand the strong inertial forces created as power hammer 12 tilts between its upright operating position and its substantially horizontal non-operating position.

The apparatus 10 further includes a tiltable support frame assembly generally designated as 34. Tiltable frame 34 includes a pair of generally vertically disposed rails 20 and 22 with ram bracket 42 extending from one of rails 20 and 22. Tiltable frame 34 further includes a pair of pivot pins 36 and 37 (see FIG. 3), a pair of lateral spaced-apart supports 46 and 48 which extend downwardly and forwardly from upright guide rails 20, 22, respectively, a cross bar 50 connected to and intermediate the opposite ends of supports 46, 48, and a lower cross bar 52 connected between bottom end portions of supports 46, 48. Cross bar 52 extends across and rests on the upper surface of chassis 24.

Tilt frame 34 further includes a pair of spaced-apart lower rails 54 and 56, and a pair of spaced-apart upper rails 58 and 60. One end of each of lower rails 54 and 56 is connected to upright guide rails 20 and 22, respectively. The opposite ends of each of lower rails 54 and 56 is connected to the lower cross bar 52. One end of each of upper rails 58 and 60 is connected to upright guide rails 20 and 22, respectively. The opposite end of each upper rails 58 and 60 is connected to supports 46 and 48, respectively, intermediate cross bar 50 and lower cross bar 52.

Power hammer 12 is supported between the vertically disposed rails 20 and 22. The outer end of ram 32 connects to bracket 42 on one of guide rails 20 and 22, and the opposite end of cylinder 30 connects to rearward cross bar 44 by pivot pin 46. When the pavement breaking apparatus 10 is tilted for non-operating travel, pivot rests 38 and 40 support upper end portions of guide rails 20 and 22. Chassis 24 carries power hammer 12 in both an upright position or in a tilted position without becoming unbalanced. Chassis 24 maintains a substantially level position by having its center of gravity balanced intermediate axles 25 and 28. This positioning of adjustable stationary support 80 and axles 25 and 28 in relation to the center of gravity substantially balances apparatus 10.

Power hammer 12 can be tilted to its upright, operating position by actuating hydraulic cylinder 30. As hydraulic fluid enters cylinder 30, it pushes ram 32 outwardly. This forces ram 32 against bracket 42 on one of guide rails 20 and 22. As ram 32 extends, power hammer 12 raises to its upright position. Tilt frame 34 prevents power hammer 12 from falling forward as a result of the forward force of extending ram 32 as will be explained hereinbelow.

At the full extent of its upward stroke, ram 32 holds power hammer 12 in the vertical position as shown in FIGS. 1–3. The forward and rearward bracing arrangement of tilt frame 34 and extended ram 32 against upright guide rails 20, 22 provide the counter forces to maintain massive power hammer 12 in the vertical position. Lower cross bar 52 rests across upper part of chassis 24 to prevent overtilting of power hammer 12 as ram 32 extends. This arrangement of tilt frame 34, therefore, provides a detent against forward tilting of power hammer 12 beyond its vertical position. To tilt the pavement breaking apparatus 10 for non-operating travel, the hydraulic pressure of cylinder 30 must be decreased. As hydraulic pressure of cylinder 30 decreases, ram 32 will not resist downward tilting of power hammer 12. As power hammer 12 tilts downwardly, ram 32 retracts into cylinder 30 until the upper end portions of guide rails 20 and 22 contact pivot rests 38 and 40.

Upright guide rails 20, 22 rigidly hold power hammer 12 therebetween. This rigid mounting of power hammer 12 restricts its movement to a reciprocating vertical movement or hammer-like momentum and substantially eliminates any horizontal force components from the impact of power hammer 12. The balancing and stability of chassis 24 also adds to the strength of power hammer 12. Restricting power hammer 12 to a vertical reciprocating movement eliminates torsion loading and, therefore, reduces stress on the upper frame portion of apparatus 10. Other features of this invention contribute to transferring from the upper frame any torsional loading which may be present as will be described hereinbelow.

Figure 6A:
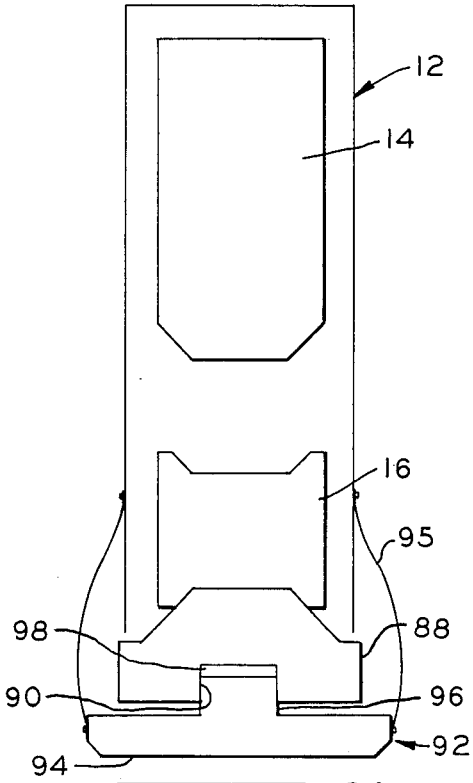
FIG. 6A is a mechanical schematic view of the hammer assembly illustrating the floating piston as it begins its downward movement.
Figure 6B:
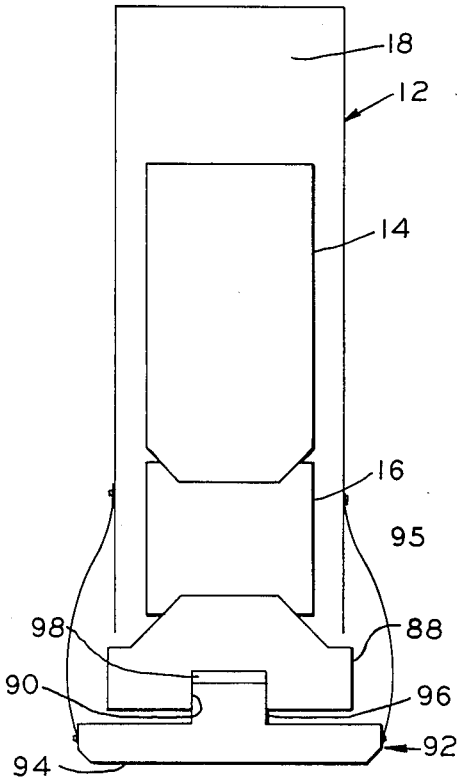
FIG. 6B is a mechanical schematic view of the hammer assembly illustrating the floating piston as it contacts the floating anvil.
Figure 6C:
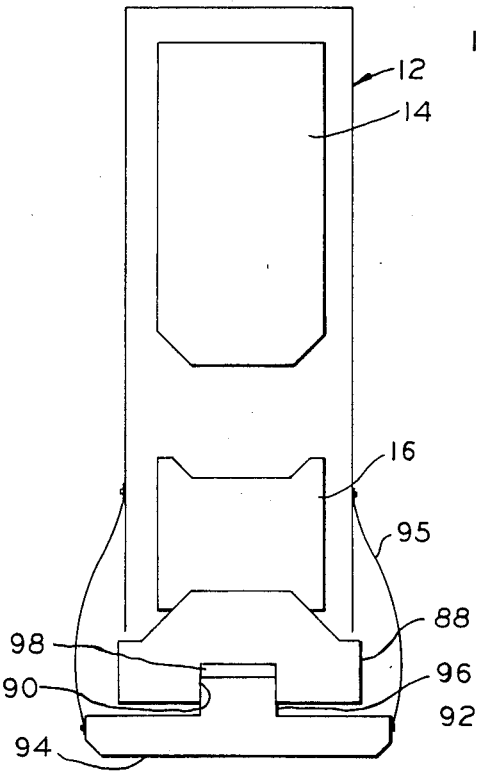
FIG. 6C is a mechanical schematic view of the hammer assembly after the combustible gases ignite and explode sending the floating piston upward and the floating anvil downward.

Referring now to FIGS. 6A, 6B and 6C, power hammer 12 includes a floating piston 14, a floating anvil 16 and a bounce chamber 18. Bounce chamber 18 is in the upper end of power hammer 12. Power hammer 12 further includes anvil retainer 86 and adapter assembly 88 which has an opening 90 extending into its bottom portion. Anvil retainer 86 houses floating anvil 16 which drives adapter assembly 88.

As floating piston 14 nears the end of its downward stroke, it compresses the air in a compression chamber (not shown). Power hammer 12, like a Diesel engine, fires as fuel injects into the highly compressed gas in its compression chamber. Floating piston 14 impacts and delivers impact energy to floating anvil 16. Ignition and explosion of the combustible gases exert equal pressure to send floating piston 14 upwardly and floating anvil 16 downwardly in hammer-like action. As floating piston 14 nears the end of its upstroke, it compresses air in bounce chamber 18 which then drives floating piston 14 downwardly to repeat the cycle.

Power hammer 12 being unchanged, there is no need to describe details of the construction of power hammer 12. The details of construction of power hammer 12 are explained in International Construction Equipment, Inc.'s brochure No. DH2-0882-5C incorporated herein by reference.

Power hammer 12 further includes drive shoe assembly 92 which includes a shoe sole 94, a neck portion 96 and a pad 98. Pad 98 is preferably a suitable cushioning material which fits on the upper surface of neck portion 96. Neck portion 96 with pad 98 thereon are received within opening 90. The positioning of pad 98 helps prevent damage to the drive shoe assembly 92 and to power hammer 12 since pad 98 acts to cushion misaligned blows delivered to the drive shoe assembly. Shoe sole 94 lies adjacent and substantially parallel with the surface being broken. Floating piston 14 reciprocates vertically and impacts against floating anvil 16 which in turn impacts upon adapter assembly 88 to send a downward force through drive shoe assembly 92. Shoe sole 94 effectively distributes the downward thrust of floating piston 14 to the surface being broken. Referring to FIG. 6C, a pair of containment cables 95 extend between the frame and selected edges of the shoe 92 for the purpose of helping to maintain the relative positioning of the components of the drive shoe assembly when the breaker is repositioned for transport.

Drive shoe assembly 92 further includes a forward surface 106, two bracket pairs 102, 104 with aligned openings 102', 102" and 104', 104", respectively, and a bar 108. The bracket pairs 102, 104 extend from opposite ends of forward surface 106, and bar 108 extends through the aligned openings 102', 102", 104', 104".

Apparatus 10 further includes a pair of flexible shoe-towing means generally designated as 110 and 112 each having a flexible belt 114 and 116 respectively. Flexible belts 114, 116 include turnbuckles 122 and 124, respectively. Turnbuckles 122, 124 have remote ends 126 and 128, respectively, with aligned transverse openings 130 and 132 therethrough, respectively. Chassis 24 further includes connecting ears 118 and 120 extending from opposite ends of cross bar 74. One end of belts 114, 116 connects to a corresponding one of opposite ends of cross bar 74 by ears 118, 120, respectively. An opposite portion of flexible belts 114, 116, connects to one end of large turnbuckles 122, 124, respectively. Bracket pairs 102, 104 receive remote ends 126, 128, respectively, and openings 130, 132 align with openings 102', 102" and 104', 104", respectively, to receive bar 108 therethrough.

In operation, the tractor pulls the pavement breaking apparatus forward over the pavement to be broken. Power hammer 12 causes the drive shoe to impact the pavement whereupon the forward advancement of drive shoe assembly 92 is interrupted while the remaining portions of the apparatus continue to move forward. As can be appreciated, this relative movement between the drive shoe and the apparatus can create undue stresses on the neck portion 96 of the drive shoe as well as create a vertical misalignment between the drive shoe-adapter assembly and the floating anvil 16. The presence of such a vertical misalignment upon impact can cause a pendulum-like swinging or rocking of the hammer resulting in undesirable torsional loading to the upper frame. Both of these results are undesirable.

In order for drive shoe assembly 92 to exert successive blows to the edge of an unworked pavement surface it must jump forward. The flexible shoe must also jump forward between successive blows to relieve or reduce the creation of undue stresses on the neck of the drive shoe or a vertical misalignment of the drive shoe-adapter assembly and the floating anvil 16. Flexible shoe-towing means 110 and 112 continually exert an upwardly and outwardly directed forward bias to the drive shoe-adapter assembly. This biasing force is provided by the flexible belts 114 and 116 which are connected to the opposite ends of the forward edge 106 of the drive shoe through the turnbuckles so that the drive shoe is evenly moved under influence of the flexible shoe-towing means. The biasing force assists the forward movement of the drive shoe after it has impacted the pavement so as to relieve or reduce the creation of undue stresses in the neck or vertical misalignment as previously mentioned.

Further, the upwardly directed component of the biasing force facilitates the movement of the drive shoe over any upwardly projecting broken pieces of pavement so as to reduce the opportunity for the forward progress of the drive shoe to become impeded upon a broken portion of the pavement.

It should also be mentioned that the oppositely disposed outwardly directed components of the biasing force exerted by the shoe-towing means serve to better stabilize and promote vertical alignment between the drive shoe-adapter assembly and the floating anvil 16. As can be appreciated, reduction of any vertical misalignment between the drive shoe-adapter assembly and the floating anvil 16 results in the force exerted on the drive shoe having a substantial vertical component. A force having a substantial vertical component serves to eliminate or reduce any torsional loading to the upper frame due to pendulum-like swinging or rocking caused by a force exerted on the drive shoe having a meaningful horizontal component.

The turnbuckles are of an adjustable axial length so as to accommodate various operating environments and sizes of drive shoes. The flexibility of the belts can also be selected to accommodate a specific operating environment.

Figure 5:
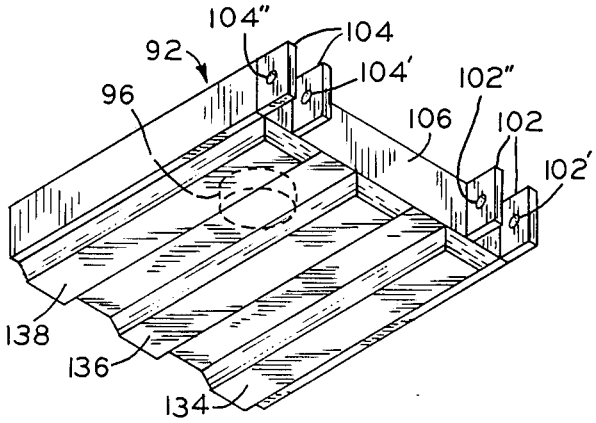
FIG. 5 is a fragmentary perspective view of the bottom surface of the drive shoe.

The shoe assemblies may be changed in accordance with the requirements of the surface. Shoe sole 94 includes multiple spaced-apart longitudinal wear bars 134, 136, 138. See FIG. 5. Wear bars 134, 136, 138 have a trapezoidal cross-section and extend along the length of shoe sole 94 in the direction of travel of the vehicle. The spaces between wear bars 134, 136, 138 provide both an area therebetween for the upheaval of the concrete being broken and a shear effect during pavement breaking.

Figure 7:
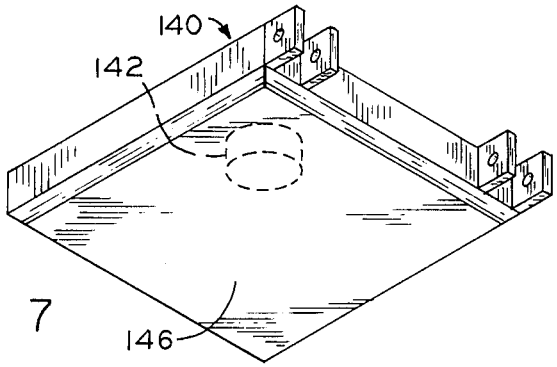
FIG. 7 is a perspective view of a tamper plate.
Figure 4:
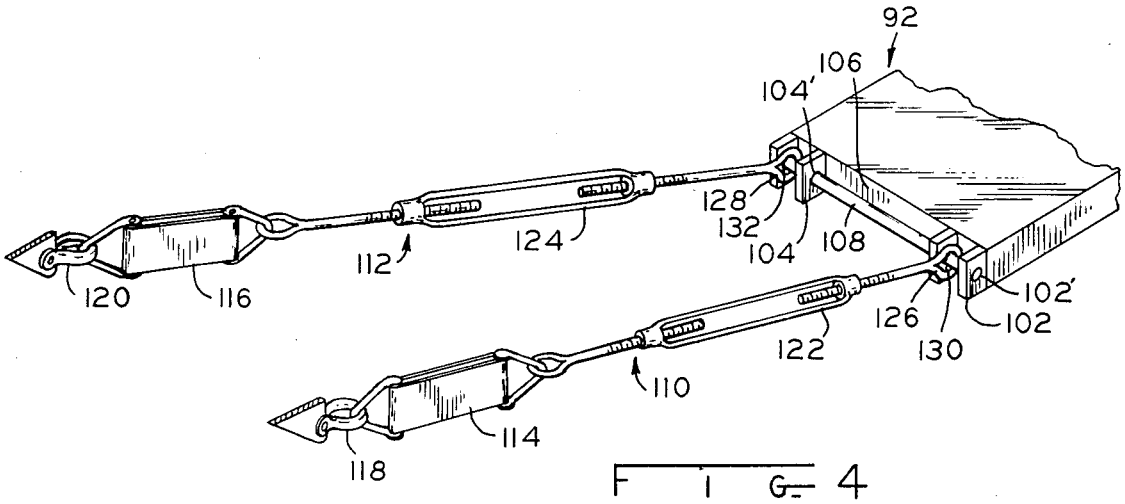
FIG. 4 is a detailed fragmentary perspective view of the flexible shoe-towing assembly.

FIG. 7 illustrates a tamper plate 140 which can replace drive shoe assembly 92. The tamper plate is used to tamp the soil. Tamper plate 140 includes a neck portion 142 and a shoe sole 146. The dimensions of tamper plate 140 will probably vary depending upon soil conditions and tamping requirements. Adapter opening 90 also receives neck portion 142.

Confining power hammer 12 to its rigid mounting between rails 20 and 22 also provides a more stable vehicle and platform as compared to prior art hammers which rock or have a pendulum-like swing or rock. As power hammer 12 operates, explosion of the fuel pushes piston 14 upwardly and evenly rams anvil 16 against adapter assembly 88 with neck portion 96 and pad 98 within adapter opening 90. Drivers of the past, which rock or have a pendulum-like swing, apply an uneven push against the adapter assembly and force out portions of the cushion material.

In addition, since a pendulum-like driver strikes at an angle due to the pendulum-like effect, its impact is divided between a vertical force component and a horizontal force component. The rigid mounting of power hammer 12 substantially eliminates any horizontally directed force. Thus, the impact of power hammer 12 will contain substantially all the force from piston 14 as it reciprocates vertically within the cylinder.

Figure 8:
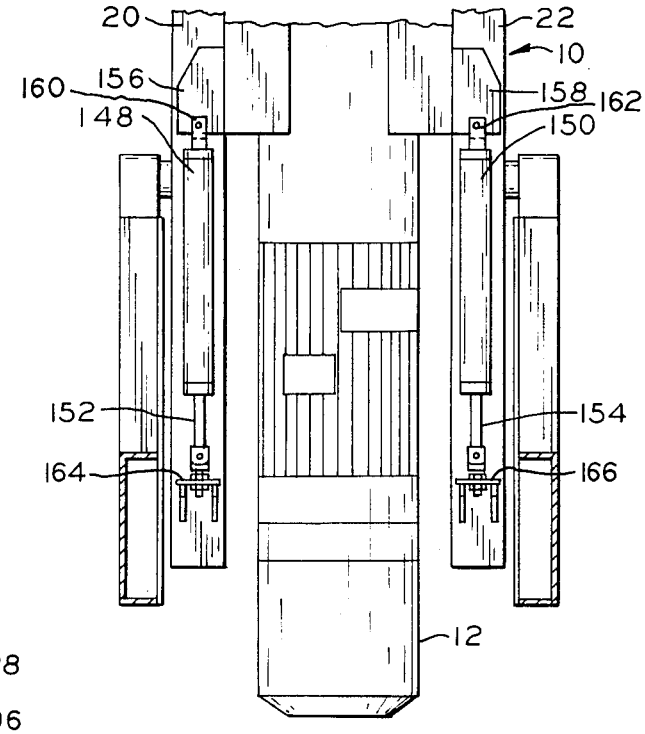
FIG. 8 is a mechanical schematic view of the lifting cylinders.

FIG. 8 illustrates a means for lifting power hammer 12 to its starting position without requiring a pulley hoist above power hammer 12. The lifting means includes the pair of hydraulic cylinders 148, 150 with extending piston rods 152, 154, respectively, a pair of extensions 156 and 158 of power hammer 12, a pair of cylinder brackets 160 and 162 and a pair of projections 164 and 166 which extend from the rearward surface of guide rails 20, 22, respectively.

Hydraulic cylinders 148, 150, provide power on opposite sides of power hammer 12 to raise power hammer 12 to its starting position. Hydraulic cylinders 148, 150, attach to extensions 156, 158, respectively, by cylinder brackets 160, 162, respectively. Terminal ends of piston rods 152, 154, are supported on projections 164, 166, respectively. As with operating cylinder 30, hydraulic cylinders 148, 150, operate on hydraulic power supplied by the towing vehicle (not shown). It is to be understood that hydraulic cylinders 148, 150, are only one of alternate methods available for raising power hammer 12 to its starting position.

The present invention is preferably made of any strong non-corrosive metal such as structural steel or the like which can bear the heavy inertial forces and stresses of an object of a large mass-like power hammer 12.

Figure 9A:
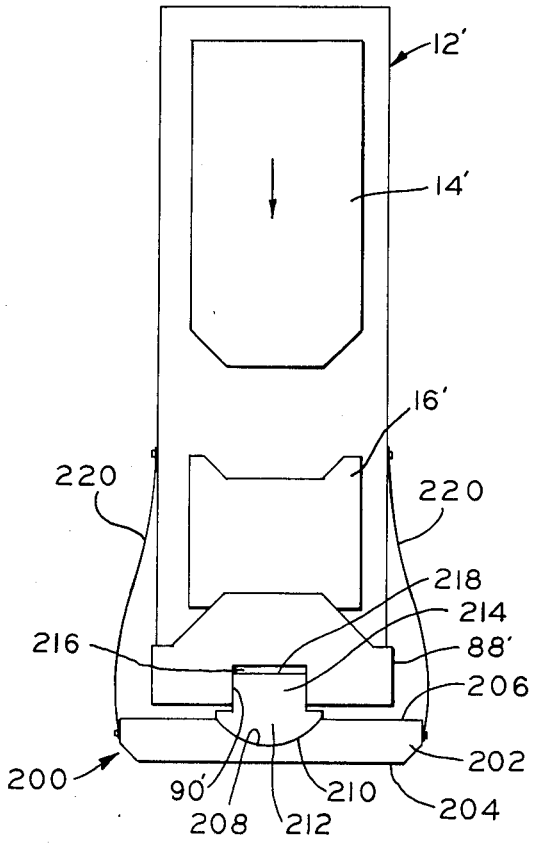
FIG. 9A is a mechanical schematic view of the hammer assembly having an alternate construction of the drive shoe assembly.
Figure 9B:
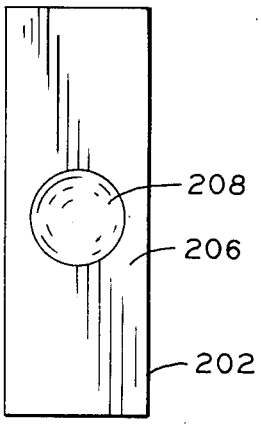
FIG. 9B is a top view of the drive shoe plate of FIG. 9A.

In FIG. 9A and 9B, there is illustrated an alternate construction of the drive shoe assembly which is generally designated as 200. The remainder of the breaker illustrated in FIG. 9A is similar to that illustrated in FIG. 6A and will be identified by the same reference numerals except that they will be primed.

Drive shoe assembly 200 includes a rectangularly-shaped shoe plate 202 having a substantially flat bottom surface 204 and a top surface 206 having a concave cup portion 208 contained therein. Drive shoe assembly 200 further includes an adapter 210 having an enlarged lower portion 212 which is complimentary in shape to concave cup portion 208 so as to be received therein. Adapter 210 further includes an integral cylindrical top portion 214 being of a diameter so as to be received within opening 90 of adapter assembly 88. A cushion 216 is sandwiched between the end wall of opening 90 and the top end 218 of top portion 214. Containment cables 220 extend between the frame of the breaker and selected edges of the shoe plate 202, and help maintain the relative positioning of the components of the drive shoe assembly 200 when the breaker is repositioned for transport.

Adapter 210 is received within concave cup portion 208 so that these two elements are movable relative to each other. This feature provides for reduced stress on the frame during the pavement breaking operation since the adapter 210 will maintain its position, and hence vertical alignment, with respect to the opening 90 notwithstanding the exertion of unevenly distributed forces on the bottom of the plate. It is quite common that during pavement breaking the forces exerted on the plate are not evenly distributed so it can be seen that this feature is advantageous.

While a specific embodiment of this invention has been described, it will be understood that it is capable of further modifications. This application is, therefore, intended to cover any variations, uses, or adaptations of the invention following the general principles thereof, and including such departures from the present disclosure as come within known or customary practice in the art to which this invention pertains and fall within the limits of the appended claims.

What is claimed is:

1. An apparatus for impacting on a hard surface such as concrete so as to break up the hard surface comprising:

a frame having a bed and an upstanding rail assembly projecting from said bed;

a drive shoe;

hammer means, attached to said rail assembly so as to be movably in only one direction and operatively connected to the drive shoe, for impacting upon said drive shoe;

said drive shoe positioned adjacent the surface so that upon being impacted by said hammer means said shoe forcefully impacts the surface so as to breakup the surface; and an adjustment means for continuously exerting a biasing force on the drive shoe so as to selectively position the drive shoe relative to the hammer means including an adjustable arm assembly wherein said arm assembly includes a resilient belt mounted to said bed, and an adjustable rigid turnbuckle having one end attached to said belt and the other end attached to said drive shoe.

2. The apparatus of claim 1 wherein said drive shoe includes opposite top and bottom surfaces, an integral neck projecting from said top surface, said neck having a distal surface, and said adapter including a top surface upon which said anvil impacts and a bottom surface in which is found a reception cavity having an end wall, a resilient member contained within said cavity, and said neck being received within said cavity so that said resilient member is sandwiched between the distal surface of said neck and the end wall of said cavity.

3. The apparatus of claim 1 wherein said hammer means includes:

an elongate chamber having opposite top and bottom ends;

a floating anvil member contained within said chamber adjacent the bottom end thereof;

a floating piston contained within said chamber between said anvil and the top end of the chamber; and an adapter operatively connecting said drive shoe to said anvil member said adapter containing an opening therein.

4. The apparatus of claim 3 wherein said drive shoe includes a shoe adapter and a shoe plate, said shoe adapter being received at one end thereof within the opening and being movably received at the other end thereof by said plate.

5. The apparatus of claim 3 further including fuel delivery means for delivering combustible fuel to said chamber so that an explosion occurs as said piston travels towards said anvil.

6. The apparatus of claim 1 wherein said adjustment means further includes a second adjustable arm assembly including a second resilient belt mounted to said bed, and a second adjustable rigid turnbuckle having one end attached to said second belt and the other end attached to said drive shoe.

7. The apparatus of claim 6 wherein said bed includes forward and rearward ends and opposite sides, said drive shoe includes a forwardly-facing side surface having opposite side edges, each of said arm assemblies attached at one end thereof to a respective side of said bed forwardly of said shoe and attached, at the other end thereof to a respective side edge of said forwardly-facing side surface.

8. An apparatus for breaking up a hard surface such as a concrete comprising:

a frame having an elongate bed with opposite front and rear ends, said bed being disposed so as to be generally parallel with the surface, said frame further including a rail assembly mounted to said bed and being disposed generally normally to the surface;

a set of wheels mounted to said bed adjacent the rear end thereof and the front end of said bed connected to a support so that the bed is spaced above the surface;

a drive shoe positioned adjacent the surface;

a hammer means mounted to said rail assembly and operatively connected to said drive shoe, for repetitively impacting against said drive shoe so as to break up the surface; and adjustment means for selectively positioning the drive shoe relative to the hammer means including a flexible belt mounted to the underneath of said bed and forwardly of said drive shoe; and a rigid turnbuckle having one end attached to said belt and the other end extending rearwardly towards and connected to said drive shoe, the axial length of said turnbuckle being adjustable.

9. The apparatus of claim 8 wherein said support is the hitch of tractor or like vehicle.

10. The apparatus of claim 8 further comprising:

a second flexible belt mounted to the underneath of said bed and forwardly of said drive shoe; and a second rigid turnbuckle having one end attached to said second belt and the other end extending rearwardly towards and connected to said drive shoe, the axial length of said second turnbuckle being adjustable.

11. An apparatus for impacting upon a surface comprising:

a frame having a bed and an upstanding rail assembly mounted to said bed;

a hammer assembly mounted to said rail assembly; and a selected one of a pair of shoes being operably connected to said hammer assembly, each of said shoes including a bottom face facing the surface, one of said shoes having a generally flat bottom face so as to tamp the surface upon impacting, a flexible belt mounted to the underneath of said bed forwardly of said shoes; and a turnbuckle having one end attached to said belt and the other end extending rearwardly towards and connected to said shoes, the axial length of said turnbuckle being adjustable.

12. The apparatus of claim 11 wherein the other of said shoes includes means for breaking up the surface upon impacting.

* * * * *

UNITED STATES PATENT AND TRADEMARK OFFICE

CERTIFICATE OF CORRECTION

PATENT NO. : 4,634,311

DATED : January 6, 1987

INVENTOR(S) : John W. Jinnings

It is certified that error appears in the above-identified patent and that said Letters Patent is hereby corrected as shown below:

Col. 2, line 15, change "is" to --are--.

Col. 2, line 16, change "are" to --is--.

Signed and Sealed this

Twenty-first Day of April, 1987

*Attest:*

DONALD J. QUIGG

*Attesting Officer*

*Commissioner of Patents and Trademarks*